US005509380A

United States Patent [19]

Tipp

[11] Patent Number: 5,509,380

[45] Date of Patent: Apr. 23, 1996

[54] TAB LIFTING TOOL FOR LIFTING CONTAINER LID TABS

[76] Inventor: Raymond P. Tipp, P.O. Box 3778, Missoula, Mont. 59806

[21] Appl. No.: 285,707

[22] Filed: Aug. 4, 1994

[51] Int. Cl.[6] ..... B67B 7/40

[52] U.S. Cl. ..... 81/3.55; D8/18; D8/40

[58] Field of Search ..... 81/3.07, 3.47, 81/3.55; D8/18, 40

[56] References Cited

U.S. PATENT DOCUMENTS

| | | | |
|---|---|---|---|
| 4,524,646 | 6/1985 | Kimberlin | 81/3.55 |
| 4,911,038 | 3/1990 | Ferrin | 81/3.55 X |

*Primary Examiner*—James G. Smith

*Attorney, Agent, or Firm*—Harry M. Cross, Jr.

[57] ABSTRACT

A tool for lifting container lid lift tabs comprises a thin, relatively long and narrow body suitable for holding in a user's thumb and fingers. The body has a front edge and top and bottom surfaces, the front edge having a beveled undersurface that extends rearwardly and downwardly at an acute angle with respect to the bottom surface whereby the tool may be slipped under a container lid tab with the beveled undersurface aligned generally parallel with surface of the container lid. The top surface has a generally planar main area and has a concavity located adjacent the front edge, the concavity intersecting the front edge and having a sloped container lid tab-contacting surface that extends upwardly and rearwardly from the front edge until intersecting with the top main area.

9 Claims, 2 Drawing Sheets

TAB LIFTING TOOL FOR LIFTING CONTAINER LID TABS

1. Field of the Invention

This invention relates to devices that aid in the lifting of container lid tabs, and particularly to such devices that are easy and convenient to use by persons having disabilities or infirmatives that inhibit their hand or finger functions. More particularly, this invention relates to metal can lid lifting devices designed to facilitate prying open metal can lid lift tabs.

2. Brief Description of the Prior Art

Persons who have arthritis in their hands and fingers, or who have some other disability or infirmative that inhibits the full functioning of their hands or fingers, have great difficulty prying open metal can lid tabs. These can lids, often referred to as "flip-top" lids, permeate our society today, being found on beverage cans, snack cans, pet food cans, and the like. Even non-metallic containers are often provided with metal can lids that incorporate tabs that must be pried up to open the can lid. Even persons who have no hand or finger disability have difficulty opening many can lid lift tabs since the tabs usually lay close to the lid surface and can only be grasped by inserting a finger nail underneath the tab edge. Persons with long or brittle finger nails, or with soft or no fingernails, have difficulty prying these tabs up so that their finger tip can be inserted underneath the tab.

Such persons have either avoided containers that employ lift tabs, or used knives or other utensils as tools to pry tabs up. Heretofore, there has not been a compact, convenient tool for lifting container lid tabs that could be easily used. Such tools as have been suggested are not of a size that could be readily carried in one's pocket, or attached to a ring chain or key ring, or secured to a metal surface such as the surface of a refrigerator door.

From the foregoing summary, it will be appreciated that it is an object of the present invention to provide a compact, easy-to-use tool for lifting container lid tabs. It is particularly an object of the present invention to provide such a tool that is of a size that can be readily carried in one's pocket, or attached to a ring chain or key ring, or secured to a metal surface such as the surface of a refrigerator door. Furthermore, it is a primary object of the present invention to provide such a tool that can be used by persons who have difficulty using their hands or fingers to pry open container lid lift tabs, or who do not want to risk damaging their finger nails.

SUMMARY OF THE INVENTION

The invention comprises a tool for lifting container lid lift tabs which comprises a thin, relatively long and narrow body suitable for holding in a user's thumb and fingers. The body has a front edge and top and bottom surfaces, the front edge having a beveled undersurface that extends rearwardly and downwardly at an acute angle with respect to the bottom surface whereby the tool may be slipped under a container lid tab with the beveled undersurface aligned generally parallel with surface of the container lid. The top surface has a generally planar main area and has a concavity located adjacent the front edge, the concavity intersecting the front edge and having a sloped container lid tab-contacting surface that extends upwardly and rearwardly from the front edge until intersecting with the top main area.

BRIEF DESCRIPTION OF THE DRAWINGS

Similar numerals of reference designate corresponding parts in all view of the drawings.

DESCRIPTION OF THE PREFERRED EMBODIMENT

Figure 5:
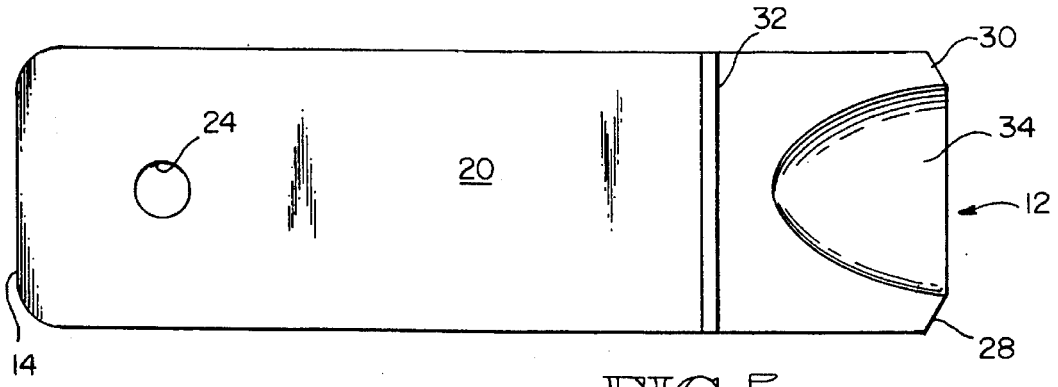
FIG. 5 is a top plan view of the FIG. 1 tool.
Figure 6:
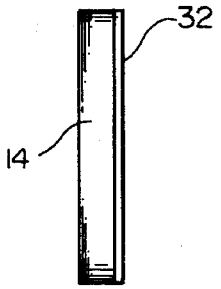
FIG. 6 is a rear edge view of the FIG. 1 tool.

Referring now in detail to the drawings, the tab lifter tool comprises a thin, rectangular body 10 having a front edge 12, a rear edge 14, side edges 16 and 18, a top surface 20 and a bottom surface 22. The rear edge 14 is provided with a transverse aperture 24 through which a bead chain or a key ring may be inserted. An adhesive-backed magnet strip may be applied to the bottom surface 22 so that the tool can be attached to a metal surface, such as a refrigerator door, for convenient access. The front edge 12 is provided with a beveled lower surface 26, and beveled side edges 28, 30. The top surface 20 is provided with a transverse thumb rest rib 32, extending from side to side, and a tab-aligning concavity 34. Concavity 34 commences at the front edge 12 and extends rearwardly and upwardly so that it tapers upward from the front edge 12 to the main planar area of top surface 20; concavity 34 thus providing a container lid tab-contacting surface that slopes upwardly at an acute angle with respect to the main area of top surface 20. Concavity 34 is wider at the front edge 12 and its side edges taper inwardly as it extends rearward; it appearing somewhat hemi-parabolic in plan view as seen in FIG. 5. The combination of the underside beveled surface 26 with the concavity 34 provides a thin lip 36 at the front edge 12 that is thinnest at the center and gradually thickens toward the sides of the front edge 12.

Figure 7:
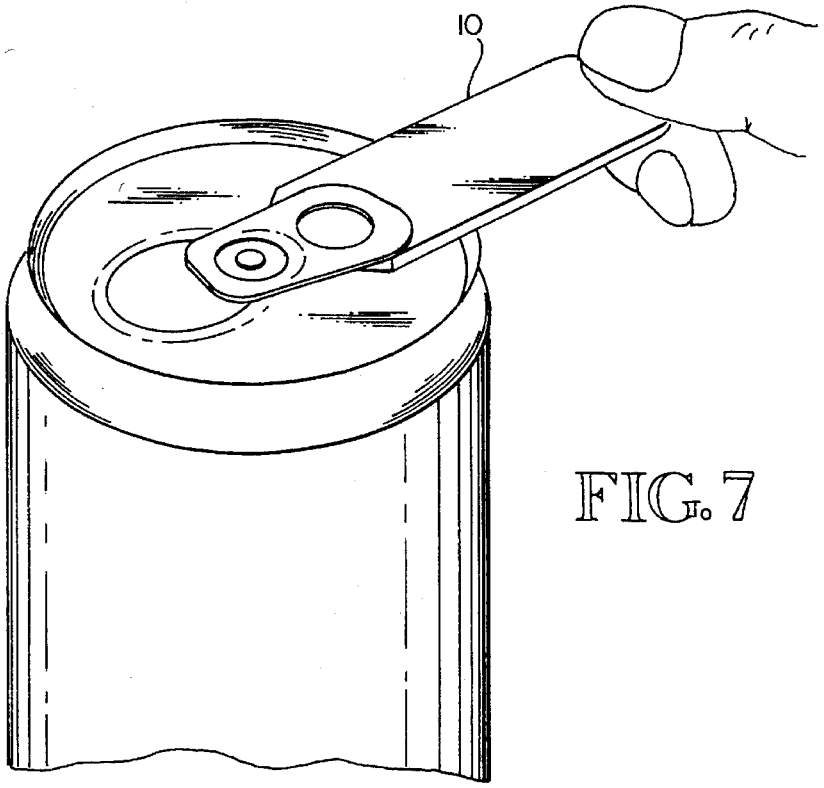
FIG. 7 is a perspective view of a beverage can illustrating the use of the FIG. 1 tool to pry the can lid tab up.

The shape of the front edge 12 as thus described, enables the front edge 12 to be slipped underneath a container lid tab, as shown in FIG. 7, to the point shown in FIG. 7. When the tool is applied to the surface of the can lid, the beveled undersurface 26 will be oriented substantially parallel to the lid surface and the lip of the concavity 34 will easily slip underneath the container's tab. As the tool is inserted beneath the container's tab, the upwardly-sloped concavity 34 will cause the tab to be raised up away from the container lid surface. Then, the tool can be pivoted upward, in a prying manner with the front edge 12 resting on the lid surface underneath the lid tab, resulting in the raising of the tab's outer ring end upward. Alternately, the tool can be pivoted downward, using the can rim as a fulcrum, in a prying manner with the front edge 12 resting on the undersurface of the lid tab, resulting in the raising of the tab's outer ring end upward. The tab's outer end is thus raised upward far enough that one can easily insert his/her finger tip beneath the tab end and continue to raise the tab upward until the container lid is opened.

Upon the insertion of the tool as aforedescribed underneath the lid tab, a user may place his/her thumb on top of the lid tab with his/her bent index finger disposed underneath the tool and pinch his/her thumb and index finger together. This pinching action creates a vice-like grip on the lid tab. Consequently, the user may then pry the lid tab up by pivoting the thumb—finger—tool combination grip upward, with the tool's front edge 12 bearing against the can lid. This use of the tool effects an extension of the can tab's effective length, thereby providing the user with increased leverage in opening the can. For someone who is pouring many drinks, such as an airline attendant, this use of the tool enables the person to quickly and easily open cans with one hand and pour the beverage with the other hand, thereby enabling the user to serve drinks faster. This use of the tool enables a person such as an airline attendant to open ring-tabbed cans hurriedly without concern for the server's fingernails and without concern about bruising the server's thumb tip.

Because the concavity 34 is semi bowl-shaped, being wider at the front edge 12, and tapering in a somewhat parabolic curve rearward, the tool will automatically center itself underneath the tab when applied to the container lid. The beveled side edges 28, 30 at the front edge 12 help in this centering feature. Beveled side edges 28, 30 also eliminate sharp edges at the front edge 12 and therefore will not contribute pocket abrasion for those user's who will carry the tool in a pocket.

Thumb rest rib 32 provides a guard to protect the user's thumb from extending so far forward that it might be pinched by the lift tab during use of the tool. Thumb rest rib 32 also functions as a limit stop that prevents the lid tab from travelling up the tool beyond the rib 32 when the tool is inserted beneath the lid tab.

The slope angle of surface 26 is about 30°, with a range of about 25°–45° being suitable. The concavity is sloped rearwardly about 15°, with a range of about 10°–25° being suitable.

Figure 1:
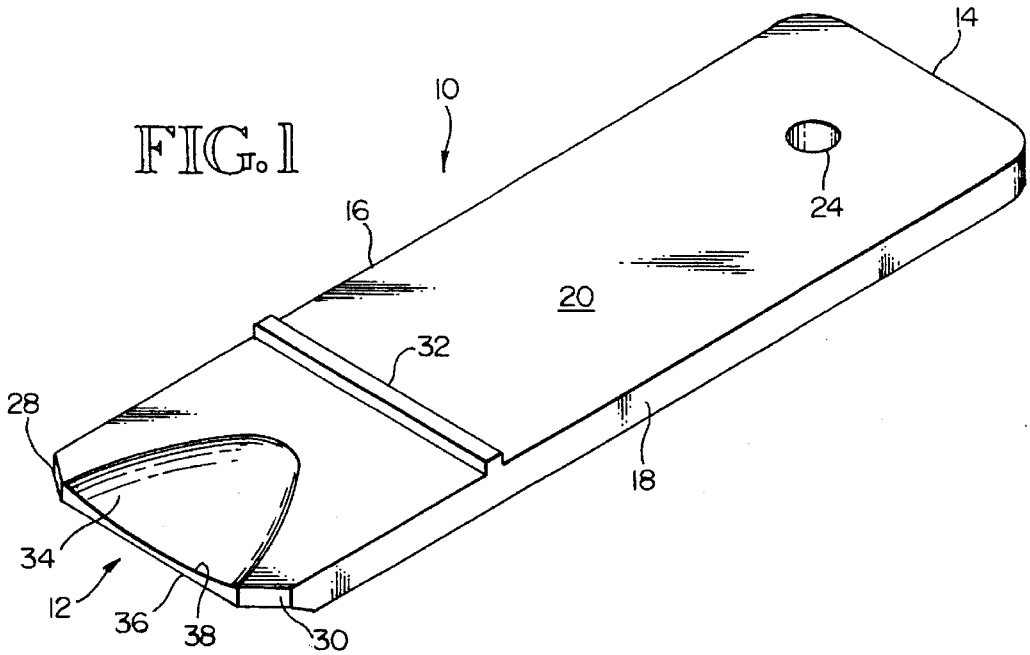
FIG. 1 is a perspective view of the tab lifter tool of this invention.
Figure 2:
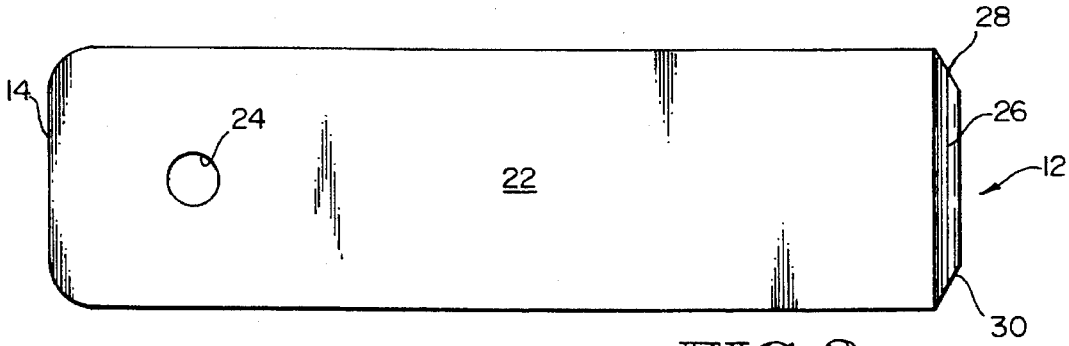
FIG. 2 is a plan view of the underside of the FIG. 1 tool.
Figure 3:
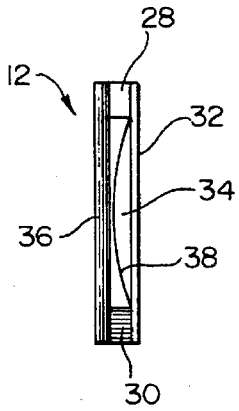
FIG. 3 is a front edge view of the FIG. 1 tool.
Figure 4:
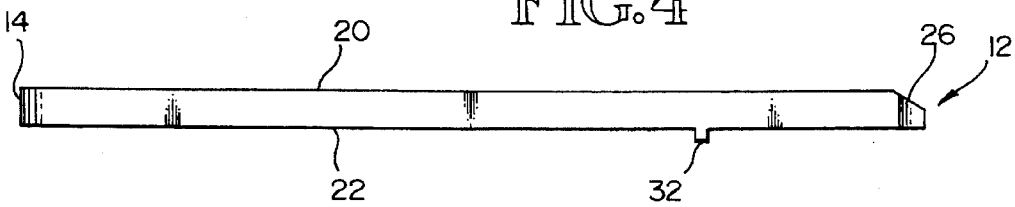
FIG. 4 is a side elevation view of the FIG. 1 tool.

The tool can be fabricated of molded plastic having a suitable formulation that will render the tool sufficiently stiff for the purpose intended. It may also be fabrication from any other suitably stiff material. The tool conveniently has a length of about 2.5 in., a width of about 0.75 in. and a thickness of about ⅛ in. The sloped undersurface 26 has a length (front-to-back) of about 3/16 in. and the beveled side edges 28, 30 have a length of about 1/16 in. Thumb rest rib 32 is located about 0.75 in. rearwardly of the front edge 12 and the front-to-rear length of the concavity 24 is about 0.5 in.. As a result of the cooperating configurations of the leading edges of the beveled undersurface 26 and the concavity 34, (see FIG. 3), the leading edge of front edge 12 has a straight bottom line 36 across its width from beveled edge 28 to beveled edge 30, and a concave top line 38 over the center two thirds of its width, with the concave top line 38 intersecting the main flat area of the top surface 20 at about the terminus of the beveled side edges 28, 30. Beveled side edges 28, 30 may be rounded, or beveled, in the top-to-bottom direction as well to further minimize pocket abrasion if desired.

When fabricated in the preferred size set forth above, the tool has a shape approximating a standard key. Consequently, when the tool is carried on a key ring or key chain, along with one or more keys, it will blend in and not inconvenience the user. The tool, therefore, will not hinder the use of a key tag that might be on the key chain or key ring that serves the user as a means to grasp or carry the key chain/ring. Alternately, the tool itself may function as such a key tag is the user desires.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A tool for lifting container lid lift tabs which comprises a thin, relatively long and narrow body suitable for holding in a user's thumb and fingers; said body having a front edge and top and bottom surfaces; said front edge having a beveled undersurface that extends rearwardly and downwardly at an acute angle with respect to said bottom surface whereby said tool may be slipped under a container lid tab with said beveled undersurface aligned generally parallel with surface of the container lid; and said top surface having a generally planar main area and having a concavity located adjacent said front edge, said concavity intersecting said front edge and having a sloped container lid tab-contacting surface that extends upwardly and rearwardly from said front edge until intersecting with said top main area, said concavity being generally hemiparabolic in configuration so as to present a concave surface that is (a) transversely concave across said front edge and (b) longitudinally concave and sloping upward from said front edge, said front edge having a straight bottom line and a curved upper line to provide a thickness that is least at the midpoint and greatest at each end, whereby said tool is self-centering when inserted under a container lid tab.

2. The tool of claim 1 wherein said body is generally rectangular in plan view with a width of about 0.75 in., a length of about 2.5 in., and a thickness of about ⅛ in.; and wherein said front edge beveled undersurface is sloped downwardly at an angle of between about 25° and 45° with respect to said bottom surface; and wherein said concavity container lid tab-contacting surface is sloped upwardly at an angle of between about 10° and 25° with respect to said top surface.

3. The tool of claim 1 wherein a thumb rest rib is provided in said top surface adjacent the rearward-most end of said concavity.

4. The tool of claim 2 wherein a thumb rest rib is provided in said top surface adjacent the rearward-most end of said concavity.

5. The tool of claim 1 wherein said body is provided with a transverse aperture; and including a bead chain looped through said aperture whereby said tool may function as a key holder.

6. The tool of claim 2 wherein said body is provided with a transverse aperture; and including a bead chain looped through said aperture whereby said tool may function as a key holder.

7. The tool of claim 1 including a magnet strip affixed to said bottom surface whereby said tool may be stored against a metal surface.

8. The tool of claim 2 including a magnet strip affixed to said bottom surface whereby said tool may be stored against a metal surface.

9. A tool for lifting container lid lift tabs which comprises a thin, relatively long and narrow body suitable for holding in a user's thumb and fingers; said body having a front edge and top and bottom surfaces; said front edge having a beveled undersurface that extends rearwardly and downwardly at an acute angle with respect to said bottom surface;

said top surface having a generally planar main area and having a concavity located adjacent said front edge, said concavity intersecting said front edge and having a sloped container lid tab-contacting surface that extends upwardly and rearwardly from said front edge until intersecting with said top main area; said concavity having a generally semi bowl-shaped outline in plan view so as to present a concave surface that is (a) transversely concave across said front edge and (b) longitudinally concave and sloping upward from said front edge, said front edge having a straight bottom line and a curved upper line to provide a thickness that is least at the midpoint and greatest at each end, whereby said tool is self-centering when inserted under a container lid tab said body being generally rectangular in plan view with a width of about 0.75 in., a length of about 2.5 in., and a thickness of about ⅛ in.; and wherein said front edge beveled undersurface is sloped downwardly at an angle of between about 25° and 45° with respect to said bottom surface; and said concavity container lid tab-contacting surface being sloped upwardly at an angle of between about 10° and 25° with respect to said top surface;

said top surface being provided with a thumb rest rib adjacent the rearward-most end of said concavity.

* * * * *